US007845308B1

(12) United States Patent
Corneille et al.

(10) Patent No.: US 7,845,308 B1
(45) Date of Patent: Dec. 7, 2010

(54) SYSTEMS INCORPORATING MICROWAVE HEATERS WITHIN FLUID SUPPLY LINES OF SUBSTRATE PROCESSING CHAMBERS AND METHODS FOR USE OF SUCH SYSTEMS

(75) Inventors: Jason Corneille, Scotts Valley, CA (US); Nancy E. Gilbert, Berkeley, CA (US); Robert D. Tas, Aromas, CA (US); Steven Flanders, San Jose, CA (US); Timothy J. Franklin, Campbell, CA (US); Jason R. Wright, Sunnyvale, CA (US); Stephen C. Jones, Tracy, CA (US); Joe Laia, Morgan Hill, CA (US)

(73) Assignee: Lam Research Corporation, Fremont, CA (US)

( * ) Notice: Subject to any disclaimer, the term of this patent is extended or adjusted under 35 U.S.C. 154(b) by 1105 days.

(21) Appl. No.: 11/536,429

(22) Filed: Sep. 28, 2006

Related U.S. Application Data

(60) Provisional application No. 60/730,452, filed on Oct. 26, 2005.

(51) Int. Cl.
*B05C 11/00* (2006.01)
*B05C 3/00* (2006.01)

(52) U.S. Cl. ..... 118/667; 118/697; 118/429

(58) Field of Classification Search ..... 118/667, 118/695–706, 429, 666; 392/314, 320; 427/99.5, 427/304, 305, 306, 345, 437, 438, 443.1
See application file for complete search history.

(56) References Cited

U.S. PATENT DOCUMENTS

| | | | |
|---|---|---|---|
| 6,846,519 | B2 | 1/2005 | Ivanov et al. |
| 6,908,512 | B2 | 6/2005 | Ivanov et al. |
| 6,913,651 | B2 | 7/2005 | Ivanov et al. |
| 6,935,638 | B2 | 8/2005 | Ivanov et al. |
| 2004/0094186 | A1 | 5/2004 | Ivanov |
| 2005/0016201 | A1 | 1/2005 | Ivanov et al. |
| 2005/0181226 | A1 | 8/2005 | Weidman et al. |

*Primary Examiner*—Yewebdar T Tadesse
(74) *Attorney, Agent, or Firm*—Kevin L. Daffer; Mollie E. Lettang; Daffer McDaniel, LLP

(57) ABSTRACT

Systems having an in-line microwave heater to heat fluids for processing a substrate are provided. An embodiment of a system includes a microelectronic processing chamber, a reservoir for storing a fluid used to process wafers within the chamber, a supply line for transporting the fluid to the chamber, and a microwave heater arranged along the supply line. The system includes processor executable program instructions for operating the microwave heater at parameters configured to heat fluid within the supply line to a temperature greater than a fluid temperature within the reservoir, such as approximately 20° C. greater than the reservoir fluid temperature. It is noted that the inclusion of an in-line microwave heater is not limited to microelectronic fabrication systems, but may be used for any system in which heated fluids are used for processing a substrate, such as but not limited to electroplating or electroless plating systems.

16 Claims, 2 Drawing Sheets

SYSTEMS INCORPORATING MICROWAVE HEATERS WITHIN FLUID SUPPLY LINES OF SUBSTRATE PROCESSING CHAMBERS AND METHODS FOR USE OF SUCH SYSTEMS

PRIORITY APPLICATION

The present application claims priority to provisional application No. 60/730,452 entitled "Systems Incorporating Microwave Heaters within Fluid Supply Lines of Substrate Processing Chambers and Methods for Use of Such Systems" filed Oct. 26, 2005.

BACKGROUND OF THE INVENTION

1. Field of the Invention

This invention generally relates to systems and methods configured for processing a substrate with a heated fluid and, more specifically, to systems and methods incorporating microwave heaters within fluid supply lines of systems used to process substrates.

2. Description of the Related Art

The following descriptions and examples are not admitted to be prior art by virtue of their inclusion within this section.

Many applications utilize heated fluids for processing a substrate. Examples of processes include but are not limited to film deposition techniques, such as electroless plating and electroplating, and microelectronic device fabrication processes, such as depositing, etching, activating, polishing, cleaning, rinsing, and drying. In some systems, fluids may be heated within a chamber configured for processing the substrate. In other cases, however, it may be advantageous to additionally or alternatively heat fluids prior to being supplied to the chamber. For instance, it may be beneficial to preheat a fluid such that the time used to bring the fluid up to the desired temperature within the chamber may be minimized. Conventional systems which heat fluids prior to being supplied to a chamber typically include electric resistive-element heaters or fluid heat exchangers arranged about a fluid storage tank and/or along a supply line coupled to the chamber. Although such heating systems may be suitable for many applications, they do have drawbacks.

In particular, since electric resistive-element heaters and fluid heat exchangers function by transferring heat through walls of the unit around which they are arranged, the boundary layer of a fluid near the walls of the unit may have a substantially higher temperature than a central stream of the fluid. In addition, electric resistive-element heaters, such as electric jacket heaters or screen-printed heaters, may be prone to producing hot spots along a unit wall due to a lack of uniformity of resistive element placement along the surface of the unit (i.e., the resistive elements may not be distributed evenly across the surface). Fluid temperature variations resulting from such characteristics of electric resistive-element heaters and fluid heat exchangers may be particularly undesirable for applications which require a tight temperature tolerance for processing a substrate uniformly.

In addition, temperature variations may be undesirable for fluids which are unstable or degrade at high temperatures. For instance, many electroless plating solutions are susceptible to decomposing at high temperatures, which alters the properties of the solution and, in effect, changes the rate and uniformity of film deposition or, in some cases, halts film deposition entirely. More specifically, high temperatures within an electroless plating solution may cause components to vaporize, dissociate, or react. In some cases, high temperatures may cause metal ions within an electroless plating solution to plate out (i.e., the metal ions may be transformed into elemental metal or metal compound particles). The transformation of the metal ions may reduce the availability of such ions to be deposited upon a substrate catalytic surface and, in some cases, may further or alternatively cause defects and/or particles to be formed.

Although electric resistive-element heaters and fluid heat exchangers may be tailored to heat a wall of a fluid storage tank or a supply line below the stability-threshold decomposition temperature of a fluid contained therein, such adaptations may undesirably limit the fluid to attain an overall desired processing temperature. In particular, since a central portion of a fluid within a fluid storage tank or a supply line may generally be heated to a lower temperature than boundary layers of the fluid at the walls of an electric resistive-element heater or a fluid heat exchanger, the overall temperature of the fluid may be heated to a lower than a targeted temperature. In some applications, low temperatures may hinder the rate of performance of the processes. For instance, deposition rates of some electroless plating processes may decrease relative to decreases in the temperatures of deposition solutions used for the processes. As such, there is a trade-off with using electric resistive-element heaters and fluid heat exchangers to heat fluids for some processing applications. Although electric resistive-element heaters and fluid heat exchangers may, in some embodiments, be sized to minimize wall temperature for a given temperature increase of a fluid (and, thus, minimize issues of temperature variation and high wall temperatures), large equipment is undesirable for many applications, such as in microelectronic fabrication where it is advantageous to minimize the area occupied by process equipment.

Another detriment of electric resistive-element heaters and fluid heat exchangers is that they have significant thermal mass. More specifically, electric resistive-element heaters and fluid heat exchangers require a significant amount of time to heat up to a desired temperature as well as a significant amount of time to cool down once power is disconnected from the units. Such time constraints may be undesirable for many applications. In particular, the time needed to heat an electric resistive-element heater or a fluid heat exchanger to a desired temperature may undesirably delay production time. Furthermore, in embodiments in which a fluid is routed through a heating system while its temperature is being raised, the fluid either has to be circulated or wasted. Discarding unused fluids increases processing costs and, in some cases, increases environmental hazard exposures. Circulating a fluid at elevated temperatures, however, may be undesirable for some applications.

For instance, many electroless plating solutions are susceptible to degrading faster over a given amount of time when exposed to elevated temperatures. As such, even though a solution may be heated by an electric resistive-element heater or a fluid heat exchanger to a temperature below a stability-threshold decomposition temperature, the solution may degrade faster since it is at an elevated temperature for a longer amount of time during a circulation cycle. Exposure to elevated temperatures may also occur when a heating system is cooling down due to the high thermal retention of electric resistive-element heaters and fluid heat exchangers. Although fluid may be flushed from lines for a cool down mode and, consequently, exposure to elevated temperatures may be limited to fluid stored within a heated storage tank, emergency shut downs or breakdowns of systems can trap fluid in supply lines, exposing the stagnant fluid to elevated temperatures.

As such, it would be advantageous to develop a system and a method for heating a fluid prior to being supplied to a chamber for processing without disrupting the rate of the process and/or advancing the decomposition of the fluid. In addition, it would be beneficial for such a system and method to minimize or eliminate high wall temperatures and temperature variation within the fluid. Such a system and method may be advantageous for any process which utilizes a heated fluid to process a substrate, including but not limited to electroless plating, electroplating, and various microelectronic device fabrication processes.

SUMMARY OF THE INVENTION

The problems outlined above may be in large part addressed by incorporating in-line microwave heaters within systems which utilize heated fluids for processing a substrate. The following are mere exemplary embodiments of systems used to fabricate a microelectronic device having in-line microwave heaters and a method for processing a microelectronic topography using such systems. Such exemplary embodiments, however, are not to be construed in any way to limit the subject matter of the claims. For instance, the systems noted below may include additional or alternative components for the fabrication of microelectronic devices. Furthermore, the concept of incorporating an in-line microwave heater is not limited to microelectronic fabrication systems, but rather may be used for any system in which heated fluids are used for processing a substrate. For example, in-line microwave heaters may be applicable for systems configured to deposit metal including but not limited to those used for the deposition of films in microelectronic devices, such as electroplating or electroless plating systems.

An embodiment of one of the systems includes a chamber configured to process one or more wafers for the fabrication of microelectronic devices, a reservoir configured to store a fluid used to process the one or more wafers, and a supply line for transporting the fluid from the reservoir to the chamber. The system further includes a microwave heating system arranged along the supply line and a storage medium comprising program instructions executable by a processor for operating the microwave heating system at parameters configured to heat a flow of the fluid within the supply line to a first temperature greater than a second temperature of the fluid within the reservoir.

Another embodiment of a system includes a chamber configured to process one or more wafers for the fabrication of microelectronic devices, a reservoir configured to hold a fluid used to process the one or more wafers, and a supply line coupled between an outlet of the reservoir and an inlet of the chamber. The system further includes a circulation line coupled between the outlet of the reservoir and an inlet of the reservoir, wherein a portion of the circulation line and a portion of the supply line include common fluid ducts. The system includes a microwave heating system arranged among the common fluid ducts and a valve arranged along the supply line between the microwave heating system and the inlet of the chamber. Moreover, the system includes a storage medium comprising program instructions executable by a processor for selectively operating the microwave heating system at a first power level when the valve is configured to inhibit fluid flow to the inlet of the chamber and at a second power level higher than the first power level when the valve is configured to allow fluid flow to the inlet of the chamber.

An embodiment of a method for processing a microelectronic topography includes storing a fluid used to process microelectronic topographies within a storage tank of a microelectronic fabrication apparatus at a first temperature and transporting the fluid from the storage tank to a process chamber of the microelectronic fabrication apparatus. The method further includes heating the fluid through use of a microwave heater arranged along a duct connecting the storage tank and the process chamber to a second temperature at least approximately 20° C. greater than the first temperature.

BRIEF DESCRIPTION OF THE DRAWINGS

Other objects and advantages of the invention will become apparent upon reading the following detailed description and upon reference to the accompanying drawings in which.

Figure 1:
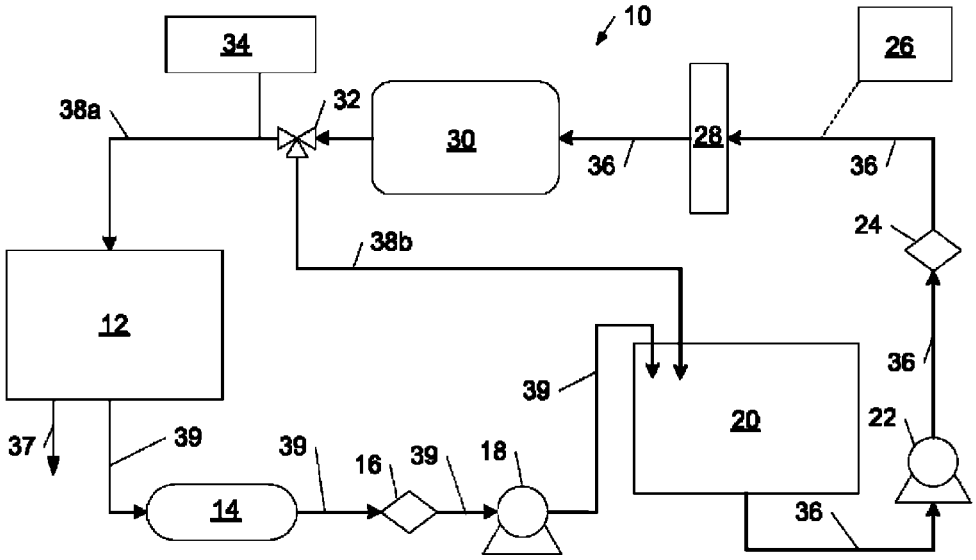
FIG. 1 depicts a schematic diagram of a substrate processing system configured with an in-line microwave heater.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 2:
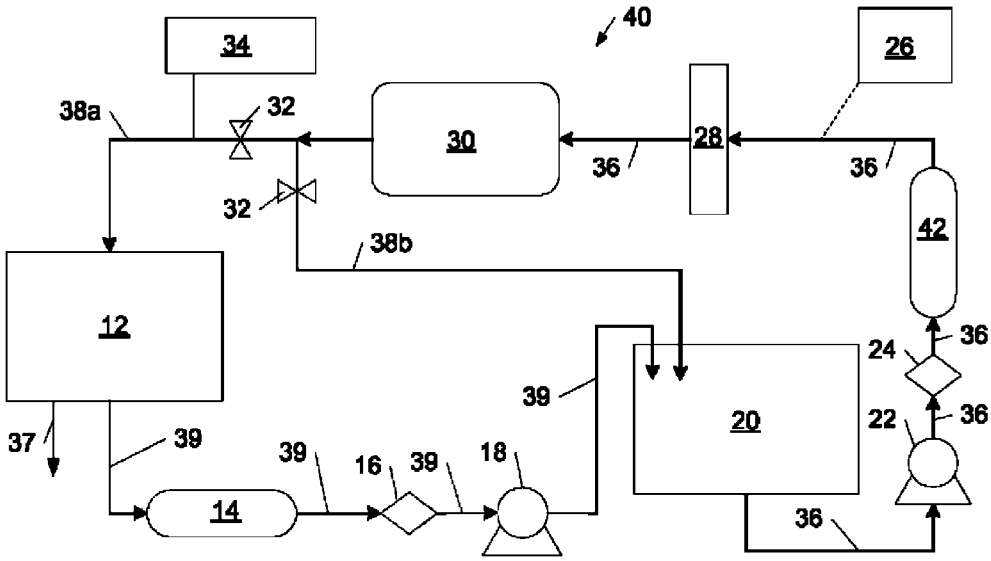
FIG. 2 depicts a schematic diagram of a different substrate processing system configured with an in-line microwave heater.
Figure 3:
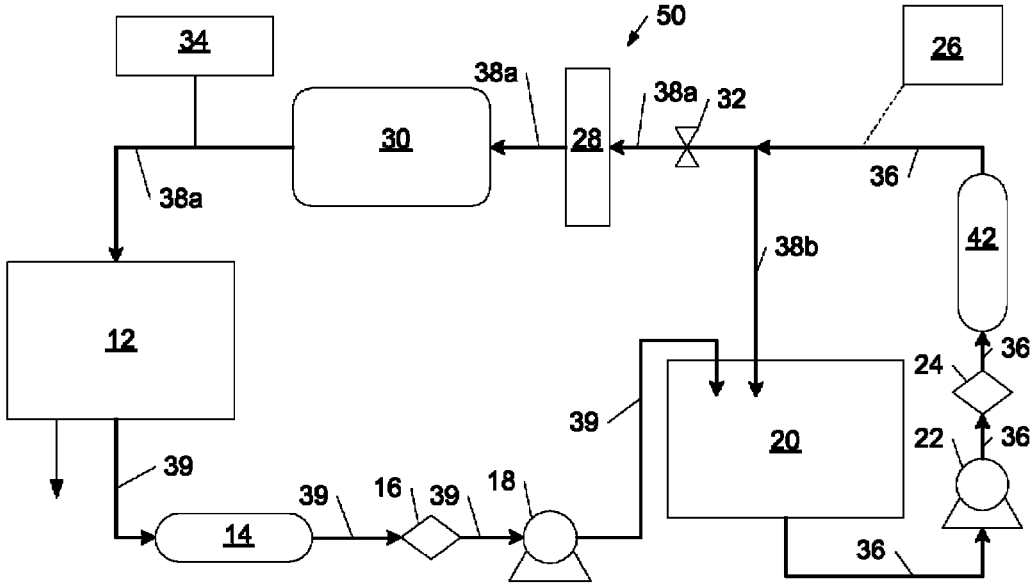
FIG. 3 depicts a schematic diagram of yet another substrate processing system configured with an in-line microwave heater.

Turning now to the drawings, exemplary embodiments of substrate processing systems configured with in-line microwave heaters are illustrated in FIGS. 1-3. In particular, FIGS. 1-3 respectively illustrate systems 10, 40, and 50 having in-line microwave heater 30. In general, systems 10, 40, and 50 may be any systems configured for processing a substrate with a heated fluid. Examples of systems include but are not limited to film deposition systems, such as electroless plating and electroplating for any substrate application, and microelectronic device fabrication systems, including those that include any one or more of depositing (including but not limited to electroless plating and electroplating), etching, activating, polishing, cleaning, rinsing, and drying. Many components of systems 10, 40, and 50 may be substantially similar and, consequently, the same reference numbers are used for some components of the systems. For the sake of brevity, many of such components are described in reference to system 10 and are not reiterated with respect to systems 40 and 50. The distinctions of systems 10, 40, and 50 are in regard to the exclusion/inclusion of additional heating systems and the placement of microwave heater 30 along a supply line between reservoir 20 and processing chamber 12 as described in more detail below.

As shown in FIG. 1, system 10 includes process chamber 12, the location at which a substrate is processed. The configuration of process chamber 12 may generally depend on the process being performed and, therefore, may vary widely for different applications. For example, process chamber 12 may be an enclosed chamber or may be an-open air container. In addition, the size and complexity of process chamber 12 may differ depending on the application in which it is employed. As such, the systems and methods described herein are not restricted by the configuration of process chamber 12. In general, process chamber 12 may include a substrate holder, one or more inlets and outlets for the transfer of fluid to and from the chamber, and any other components which may be used to process a substrate. Such a collection of components is not illustrated in FIG. 1 to simplify the drawing. In some embodiments, process chamber 12 may be configured to heat or cool a substrate held therein, such as having a substrate holder configured to heat and/or cool a substrate.

In some embodiments, process chamber 12 may be configured to process one or more wafers for the fabrication of microelectronic devices. More specifically, process chamber 12 may be configured to conduct one or more processing steps, such as depositing, etching, activating, polishing, cleaning, rinsing, drying, or any combination of such processes associated with the fabrication of microelectronic devices. As such, process chamber 12 may be adapted to produce conditions which may be necessitated by one or more steps of a microelectronic device fabrication process. In particular, process chamber 12 may be adapted to generate environments with pressures below, at, or above atmospheric pressure as well as temperatures ranging between approximately −50° C. and approximately 800° C. In addition, process chamber 12 may be adapted to process a microelectronic topography with a fluid in any state of matter known to be used in the microelectronic fabrication industry for a respective process step. As such, process chamber 12 may be adapted to treat a microelectronic topography with a liquid, gas, or plasma, including gases in a standard state or an excited state (i.e., a photon-activated gas state). Exemplary configurations of process chambers and process chamber components that may be used for process chamber 12 for the fabrication of microelectronic devices are described in U.S. Pat. Nos. 6,846,519; 6,908,512; 6,913,651; and 6,935,638; and U.S. Patent Application No. 2004-0094186, which are incorporated by reference as if fully set forth herein.

In some embodiments, process chamber 12 may be used for processes associated with an electroless deposition process, including any processes performed prior to, during, and/or subsequent to an electroless deposition process. For example, in some cases, process chamber 12 may be used to activate a surface of a microelectronic topography such that a layer may be subsequently deposited using an electroless deposition solution within process chamber 12 or within a different process chamber. In addition or alternatively, process chamber 12 may be used for polishing, rinsing, and/or cleaning an electrolessly deposited layer as well as depositing a cap layer upon the electrolessly deposited layer. In yet other embodiments, process chamber 12 may simply be used for electroless deposition of a layer.

In any case, process chamber 12 may be additionally or alternatively used for processes not associated with an electroless deposition process as well. For example, in other embodiments, process chamber 12 may be configured for processes associated with an electroplating process, including any processes performed prior to, during, and/or subsequent to an electroless deposition process. For instance, in some cases, process chamber 12 may be configured with an anodic component and an electrical source coupled thereto such that cathodic components may be plated within an electroplating solution. It is noted that the configuration of process chamber 12 for electroless plating and electroplating processes may be for the fabrication of microelectronic devices, but is not necessarily so limited. In particular, process chamber 12 may be configured for electroless plating and electroplating processes of any substrate. More generally, process chamber 12 may be configured for any process which includes a heated fluid for processing any type of substrate.

As shown in FIG. 1, system 10 further includes reservoir 20. In general, reservoir 20 may be adapted to store a fluid used to process a substrate within process chamber 12. As noted above, process chamber 12 may be used for a number of different processes. As such, reservoir 20 may be adapted to store a number of different types of fluids, including liquids, gases, or any combination thereof, which are used for processing a substrate within process chamber 12. In some applications, a fluid stored within reservoir 20 may be configured to alter the properties of a substrate surface, such as in deposition, etching, activation, polishing, and cleaning processes. Such a fluid may generally be referred to herein as being configured to reactively process a substrate. On the other hand, a fluid configured to rinse (e.g., remove debris or remove remaining processing fluid) or dry a substrate may generally be referred to as a non-reactive fluid. Examples of non-reactive fluids may include but are not limited to deionized water and mixtures having a chief concentration of noble gases.

In some cases, the fluid stored within include reservoir 20 may be associated with processes that treat a microelectronic topography. For example, the fluid may include a deposition liquid or gas, an etchant liquid or gas, a polishing slurry, a cleaning/rinsing solution, or a drying gas. In addition or alternatively, the fluid stored within include reservoir 20 may be associated with electroless plating or plating processes, regardless of whether the processes are employed for the fabrication of microelectronic devices or other types of substrates. For example, the fluid may, in some embodiments, be an electroless deposition solution. In other embodiments, the fluid stored within reservoir 20 may be configured for the treatment of a substrate prior to or subsequent to an electroless deposition process, such as a surface activation solution or a post-rinsing solution. In some embodiments, the fluid may include metal constituents, such as used in electroless plating surface activation solutions or metal deposition solutions.

In general, reservoir 20 and process chamber 12 may each include one or more reservoirs and chambers, respectively. In particular, process chamber 12 may include one or more chambers coupled to one or more storage tanks of reservoir 20. In this manner, reservoir 20 may be used to supply a fluid to a single process chamber or a plurality of process chambers. In addition, process chamber 12 may be supplied with a fluid from a single reservoir or a plurality of reservoirs. In cases in which process chamber 12 includes a plurality of chambers, the chambers may either be serially coupled to each other or may be arranged in parallel with respect to reservoir 20. Similarly, reservoir 20 may include a plurality of storage tanks coupled in series or in parallel with respect to process chamber 12. In some cases, system 10 may include one or more additional sets of reservoirs such that other fluids may be supplied to one or more process chambers of system 10. Such additional sets of reservoirs as well as multiple chambers for process chamber 12 and plurality of storage tanks for reservoir 20 are not shown in FIG. 1 to simplify the drawing. As used herein, a "set" of reservoirs may generally refer to one or more storage tanks configured for the storage of a particular fluid used to process a substrate within one or more process chambers coupled to the set of reservoirs.

In cases in which reservoir 20 includes a plurality of serially coupled storage tanks, the tanks may, in some embodiments, have different sizes and/or may be configured to store a fluid at different temperatures. In particular, a reservoir arranged closer to process chamber 12 may, in some cases, be configured to hold a different volume of fluid than a reservoir arranged farther from process chamber 12. In addition, a reservoir arranged closer to process chamber 12 may, in some cases, be configured to maintain a fluid at a different temperature than a reservoir arranged farther from process chamber 12. In general, inducing different fluid temperatures among different reservoirs of a system may be accomplished by a plurality of heaters and/or coolers arranged within storage tanks of the fluid and/or along intervening pipes of the storage tanks. Such tank heaters and in-line heaters may include microware heaters, infrared heaters, electric resistive-element heaters, fluid heat exchangers, and any combination thereof.

In some embodiments, a plurality of serially coupled storage tanks of reservoir 20 may be characterized into different temperature zones that increase in temperature as their relative distance from process chamber 12 decreases. In this manner, the temperature of the fluid may be increased as it is supplied to process chamber 12. In addition or alternatively, the relative amounts of fluid the plurality of tanks of reservoir 20 may be adapted to hold may decrease with the proximity of the tanks to process chamber 12. In other words, reservoir 20 may have a plurality of reservoirs of different volumes serially arranged in order of their volumes in which the reservoir with the smallest volume is closest to the process chamber. In other embodiments, however, reservoir 20 may have a plurality of reservoirs having substantially similar volumes. An exemplary system having a plurality of reservoirs configured to store a fluid within different temperature zones and, in some embodiments, within different volumes for supply of the fluid to a process chamber is described in U.S. Patent Application No. 2005/0016201, which is incorporated by reference as if fully set forth herein.

In general, the adaptations of system 10 to characterize storage tanks of reservoir 20 in zones of increasing temperature ranges relative to their distances to process chamber 12 may be used to minimize the amount of time a fluid is at an elevated temperature and, in effect, minimize the advancement of fluid decomposition. In addition, scaling down reservoir volumes between storage tank/s 24 and process chamber 12 may further aid to such an effect. In particular, changing the temperature of relatively small volumes of fluid will generally let the fluid be brought to a desired temperature for the fabrication process in process chamber 12 while minimizing the advancement of the fluid decomposition. As a result, the adaptations of system 10 to characterize a plurality of storage tanks of reservoir 20 into different temperature zones and, in some cases, as different volumes may be used to optimize the life of a fluid such that material and waste disposal costs may be reduced. In addition, the adaptations may be used to minimize thermal fluctuations of a fluid within process chamber 12 such that the deposition rate at which the fabrication step is conducted may be uniform.

As described above, a minimization of time at elevated temperatures and thermal fluctuations may be advantageous when employing electroless deposition fluids. In particular, minimizing an electroless deposition solution's time at an elevated temperature may reduce the solution's susceptibility to decompose over a period of time. In addition, a minimization of thermal fluctuations may be particularly advantageous for limiting variations in the deposition rate of an electroless deposition process. The adaptations of characterizing a plurality of storage tanks in different temperature zones and/or of different volumes, however, is not restricted to electroless deposition processes. In particular, the adaptations may be employed for any application in which systems 10 may be used. Further, the systems described herein are not restricted to having a plurality of storage tanks for reservoir 20. Rather, reservoir 20 may represent a single storage tank for system 10.

As shown in FIG. 1, system 10 includes plurality of ducts 36 and intervening components interposed between an outlet of reservoir 20 and valves 32. The intervening components may include pump 22 for transferring fluid through ducts 36 and filter 24 for removing particle debris within the fluid. The intervening components may further include gas displacement system 28 for displacing a gas within the fluid which may hinder the processing of a substrate within process chamber 12. An example of a gas which may hinder electroless plating processes is oxygen. In particular, a significant concentration of oxygen within an electroless deposition solution may cause non-uniform plating. In such cases, gas displacement system 28 may function as an oxygen scavenger, inert gas supplementer (such as nitrogen, for example), or any combination thereof. It is noted that gas displacement system 28 may be configured to displace a gas other than oxygen and is not necessarily specific to electroless deposition solutions. In addition, the adaptations of gas displacement system 28 (i.e., whether it is a gas scavenger, gas supplementer, or a combination thereof) may vary among different applications. In-line microwave heater 30 is also arranged along ducts 36 for heating the fluid passing from reservoir 20. A more detailed description of the operation of in-line microwave heater 30 is provided below. It is noted that the order of pump 22, filter 24, gas displacement system 28, and in-line microwave heater 30 among ducts 36 may be altered from the depiction in FIG. 1. For instance, filter 24 and/or gas displacement system 28 may alternatively be arranged downstream from microwave heater 30 prior to reaching valves 32. Alternatively, system 10 may not include filter 24 and/or gas displacement system 28.

Two lines extend from the intersection of ducts 36 and valves 32 in FIG. 1, indicating alternative fluid flow paths are provided in system 10. In particular, fluid line 38*a* extends from valves 32 to an inlet of process chamber 12, forming a fluid supply line to process chamber 12. In addition, fluid line 38*b* extends from valves 32 to an inlet of reservoir 20, forming a circulation line to reservoir 20. A circulation line may, in some embodiments, be advantageous for keeping the composition of a fluid homogenized. In addition, circulating the fluid may aid in maintaining the fluid within a specified temperature range. For example, maintaining a fluid within a temperature range which does not substantially advance the life and/or change the composition of the fluid may be advantageous for storing the fluid. Since fluid lines 38*a* and 38*b* both extend from valves 32 which, in turn, are coupled to ducts 36, ducts 36 may be referred to being common to both the supply line and circulation line of system 10. In other embodiments, fluid line 38*b* may be omitted from system 10 and, consequently, system 10 may not include a circulation line between ducts 36 and reservoir 20.

It is noted that although ducts 36 and fluid lines 38*a* and 38*b* may be adapted to store some of the fluid during certain moments of the process, reservoir 20 is clearly distinct from ducts 36 and fluid lines 38*a* and 38*b* in that reservoir 20 is configured to store a considerable larger amount of fluid than ducts 36 and fluid lines 38*a* and 38*b*. In particular, reservoir 20 may be distinguished as reservoirs, while ducts 36 and fluid lines 38*a* and 38*b* may be distinguished as passageways. It is further noted that system 10 may be adapted to provide fluids other than the fluid stored in reservoir 20 to process chamber 12 in some embodiments. In particular, system 10 may be adapted to supply a plurality of fluids either simultaneously or sequentially into process chamber 12. Consequently, system 10 may include a plurality of reservoirs and supply lines other than reservoir 20 and ducts 36 and fluid lines 38*a* and 38*b* for supplying fluids to process chamber 12. Such a plurality of other reservoirs and supply lines are not illustrated FIG. 1 in order to simplify the drawing.

In addition to fluid lines 38*a* and 38*b*, system 10 may include waste line 37 and reclaim line 39 coupled to outlets of process chamber 12. In particular, system 10 may be configured to dispense fluid from system 10 subsequent to its use in process chamber 12 through waste line 37 to be disposed. Alternatively, fluid from process chamber 12 may be returned to reservoir 20 for storage, particularly when the fluid has not decomposed or still has an adequate process life. In this manner, the fluid may be reused such that material and disposal costs may be minimized. The determination of whether the state of the fluid is suitable to be recycled may involve using analytical tests to evaluate the fluid or may be based on historical data of the system.

As shown in FIG. 1, reclaim line 39 may include heater/cooler 14 as well as filter 16 and pump 18, the order of which along reclaim line 39 is not necessarily limited to the depiction in FIG. 1. As noted above, it may be advantageous to maintain a fluid stored within reservoir 20 within a temperature range lower than a temperature range at which a substrate is processed within process chamber 12. As such, heater/cooler 14 may, in some embodiments, be configured to lower the temperature of fluid dispensed from process chamber 12 along reclaim line 39. In other embodiments, the fluid may be heated. In either case, system 10 may sometimes include components other than the ones shown in FIG. 1. For instance, system 10 may include process control devices, such as temperature and/or pressure gauges, within ducts 36, fluid lines 38*a* and 38*b*, reclaim line 39, reservoir 20 and/or process chamber 12. In addition, system 10 may be adapted to control the flow rate and time at which a fluid is transferred between reservoir 20 and/or supplied to process chamber 12. The illustration of such additional components is omitted from FIG. 1 in order to simplify the drawing.

In general, valves 32 may include a valve for allowing/prohibiting fluid flow to fluid line 38*a* and another valve for allowing/prohibiting fluid flow to fluid line 38*b*. In some embodiments, the valves may be coupled at the same intersection with ducts 36 as denoted in FIG. 1. In other embodiments, valves 32 may be arranged along fluid lines 38*a* and 38*b*, respectively. An exemplary embodiment of such a configuration is illustrated in FIG. 2. In yet other embodiments, only one valve may used to control the routing of fluid from ducts 36. In particular, a single valve may be used to change the allowance of fluid flow among fluid lines 38*a* and 38*b* and, in effect, change the fluid line which is prohibited for fluid flow. Alternatively, a single valve may be arranged along fluid line 38*a*, providing fluid flow control for the line, and fluid line 38*b* may be absent of a valve. An exemplary embodiment of such a configuration is illustrated in FIG. 3.

Regardless of the configuration of valves therein, the operation of in-line microwave heater 30 within system 10 may be dependent on whether a valve is used to allow or prohibit fluid flow along fluid line 38*a*. In particular, the operation of in-line microwave heater 30 may be operated at a first power level when the valve is configured to inhibit fluid flow to the inlet of process chamber 12 and at a second power level different than the first power level when the valve is configured to allow fluid flow to the inlet of the chamber. In applications in which it is desirable to heat a fluid for processing a substrate relative to its temperature within reservoir 20, it may be desirable to operate in-line microwave heater 30 at a second power level higher than the first power level when the valve is configured to allow fluid flow to the inlet of the chamber. More specifically, operating in-line microwave heater 30 at a higher power may increase a temperature of a fluid routed to process chamber 12 as compared to the temperature of the fluid when circulated back to reservoir 20.

In some embodiments, in-line microwave heater 30 may not be used to substantially heat a fluid through ducts 36 when a valve prohibits flow to process chamber 12 and, thus, the first power level may be negligible. In particular, negligible amounts of power or no power may be supplied to in-line microwave heater 30 when a valve prohibits flow to process chamber 12. In such cases, the second higher power level at which in-line microwave heater 30 is used to heat a fluid when a valve allows flow to process chamber 12 may be greater than or equal to approximately 0.3 kilowatts (kW) and, in some cases, between approximately 2.0 kW and approximately 20 kW. In some cases, however, in-line microwave heater 30 may be operated to substantially heat a fluid within ducts 36 when fluid flow is prohibited to process chamber 12. In such cases, the first power level may be configured to heat the fluid within a preset temperature range, and the second power level may be configured to heat the fluid to a temperature greater than the preset temperature range. Regardless of whether a fluid is heated when it is prohibited from being transported to process chamber 12, in-line microwave heater 30 may generally be operated at microwave frequencies between approximately 0.5 gigahertz (GHz) and approximately 6.0 GHz and, in some cases, a microwave frequency of approximately 2.45 GHz may be used.

An exemplary first power level supplied to in-line microwave heater 30 when a valve prohibits flow to process chamber 12 and fluid is heated within ducts 36 may generally be between approximately 250 watts and approximately 750 watts and, in some embodiments, specifically around 500 watts. In contrast, the second higher power level supplied to in-line microwave heater 30 when a valve allows flow to process chamber 12 may generally be greater than or equal to approximately 2.0 kilowatts (kW) and, in some cases, between approximately 2.0 kW and approximately 20 kW, and more specifically, between approximately 3.0 kW and approximately 6.0 kW to heat the fluid to a comparatively higher temperature than when the fluid is prohibited from flowing to process chamber 12.

In some embodiments, such exemplary operational parameters for in-line microwave heater 30 may be specific to an electroless deposition process used for the fabrication of microelectronic devices. In particular, the aforementioned ranges of power may be specific to an electroless deposition solution which is maintained at a temperature between approximately 30° C. and approximately 65° C. in reservoir 20 and/or through the circulation line comprising ducts 36 and fluid line 38*b*. In addition, the aforementioned ranges of power may be specific to an electroless deposition solution having a dissolved oxygen concentration between approximately 45 ppm and approximately 450 ppm. Furthermore, the aforementioned ranges of power may be specific to an electroless deposition solution which is heated to a temperature between approximately 70° C. and approximately 120° C. at a flow rate less than approximately 20 liters per minute prior to having a wafer subjected thereto for an electroless deposition process.

It is postulated that the aforementioned ranges of power may be satisfactory for heating other metal deposition solutions flowing at such a rate for such a given temperature increase, regardless of whether its application is for microelectronic fabrication. In particular, it is postulated that the aforementioned ranges of power may be satisfactory for heating fluids including metal constituents without degrading the fluids or causing a fire hazard upon exposure of fluids to the microwave frequencies, particularly since no degradation of fluids or fire hazards have occurred with heating electroless deposition solutions with in-line microwave heaters during the development of the systems described herein. It is further postulated that non-metallic fluids may be heated by microwave heaters operated at broader ranges of power and microwave frequencies and, therefore, the aforementioned ranges may be larger or smaller in such cases.

In general, one of the advantages of employing in-line microwave heater 30 within system 10 is that the temperature of a fluid therein may be increased dramatically in a short period of time and nearly instantly. In particular, in-line microwave heater 30 may be configured to raise the temperature of fluid by more than approximately 20° C. in a single pass through the heater and, in some embodiments, greater than or equal to approximately 30° C. or greater than or equal to approximately 50° C. in a single pass. Consequently, processing time to heat a fluid and time a fluid is at elevated temperatures may be reduced relative to conventional heating systems, such as with electric resistive-element heaters and fluid heat exchangers. As a result, processing costs will be reduced due to lower chemical consumption, decreased frequency of production tool downtime to replace decomposed solution, and reduced energy costs. In addition, programming for timing the heating of a fluid relative the receipt of a substrate within process chamber 12 may be simplified. Furthermore, in-line microwave heater 30 applies microwaves to the inner portion of a fluid stream to heat a fluid and, consequently, the hottest part of the fluid will not be along the walls of the fluid ducts where relatively slow moving boundary layers of the fluid flow exist. As a consequence, issues associated with high wall temperatures are mitigated. Moreover, in-line microwave heater 30 has negligible thermal mass. In particular, in-line microwave heater 30 does not retain heat and, therefore, when power is terminated from the microwave heater, the system is no longer a source of heat.

In general, in-line microwave heater 30 may include a power supply and a magnetron for generating the microwaves. In addition to a power supply and a magnetron, in-line microwave heater 30 may include a waveguide, tuner, and an applicator. Such components may be arranged among ducts 36 or in-line microwave heater 30 may be configured to transmit generated microwaves in the vicinity of ducts 36 such that at least the power supply may be spaced apart from ducts 36. The spaced apart configuration may be advantageous in embodiments in which the area occupied by ducts 36, fluid lines 38*a* and 38*b*, and process chamber 12 is limited, such as in microelectronic device fabrication.

In some embodiments, the operation of in-line microwave heater 30 may be computer-controlled (i.e., controlled through use of program instructions which are executable by a processor of a computer). As such, in-line microwave heater 30 may, in some embodiments, include or may be configured to access a storage medium comprising such program instructions. In general, the term "storage medium", as used herein, may refer to any electronic medium configured to hold one or more set of program instructions, such as but not limited to a read-only memory, a random access memory, a magnetic or optical disk, or magnetic tape. The term "programming instructions" may generally refer to commands within a program to perform a particular function, such as to supply power to in-line microwave heater 30.

In some cases, system 10 may include central processing unit (CPU) 26, as shown in FIG. 1, to store program instructions for operating in-line microwave heater 30. In some embodiments, CPU 26 may further include program instructions to control other components of system 10, such as but not limited to pumps 18 and 22, gas displacement system 28, valves 32, temperature gauge 34 (system 10 may include temperature gauge 34 coupled to fluid line 38*a* such that the temperature of the fluid therein may be monitored), process chamber 12, heater/cooler 14, and/or reservoir 20. Consequently, the method described in reference to FIG. 4 may, in some embodiments, be a computer-implemented method. In general, CPU 26 may be coupled to the components of system 10 which it is configured to control. Such individual connections to the components, however, are not illustrated FIG. 1 to simplify the illustrations of system 10. Rather, CPU 26 is shown coupled to system 10 by a dotted line to show a general connection to the components included within system 10.

As noted above, CPU 26 may be configured to control components other than in-line microwave heater 30. The control of the other components may either be independent or in relation to the operation of in-line microwave heater 30. For example, CPU 26 may be configured to control the opening and closing of valves 32 as well as set the power level at which to operate in-line microwave heater 30 relative to the positions of valves 32. In this manner, the routing of the fluid between fluid lines 38*a* and 38*b* may be controlled and the power levels of in-line microwave heater 30 may be adjusted according to the routing of the fluid. Furthermore, feedback from temperature gauge 34 may be used to control the level of power supplied to microwave heater 30. In particular, the temperature of the fluid within fluid line 38*a* measured by temperature gauge 34 may be compared to a target temperature or target temperature range and the power level of in-line microwave heater 32 may be adjusted accordingly.

Moreover, CPU 26 may include program instructions for controlling the rate of fluid flow through system 10 and, in some cases, such fluid flow control may be relative to the power level of in-line microwave heater 30. In particular, the rate of fluid flow through in-line microwave heater 30 may be monitored and compared to a target rate and the power level of in-line microwave heater 32 may be adjusted accordingly or vice versa. An exemplary range of flow for transferring a fluid through in-line microwave heater 30 when the fluid is allowed to flow to process chamber 12 and, thus, when the fluid is heated to a temperature for processing the substrate may generally be less than approximately 20 liters/minute (L/min) and, in some cases, between approximately 0.8 L/min and approximately 10 L/min. In some embodiments, the fluid flow may be controlled such that a variation of the fluid flow rate is less than or equal to approximately 0.5 L/min and, in some cases, less than approximately 0.2 L/min or less than approximately 0.1 L/min.

An alternative configuration of a system for processing a substrate which includes an in-line microwave heater is shown in FIG. 2. In particular, FIG. 2 illustrates system 40 having in-line microwave heater 30 as well as several other components described in reference to system 10 of FIG. 1. System 40 differs from system 10, however, by the inclusion of additional heater 42 along ducts 36. In general, additional heater 42 may include any system configured to provide heat to a fluid within ducts 36, such as an in-line microwave heater as described above in reference to in-line microwave heater 30 or any conventional in-line heater including electric resistive-element heaters, fluid heat exchangers, and infrared heat exchangers. Furthermore, additional heater 42 may be configured, alone or in conjunction with in-line microwave heater 30, to maintain fluid within the circulation line about reservoir 20 within a particular temperature range (i.e., when a valve is used to prohibit fluid flow to process chamber 12 along fluid line 38*a*). Such a temperature range may be lower than the temperature range at which a substrate may be processed within process chamber 12 as described below. Another distinction between system 40 in FIG. 2 and system 10 in FIG. 1 is the alternative arrangement of valves 32 along fluid lines 38*a* and 38*b*, respectively. In particular, valves 32 do not necessarily need to be arranged at the same location, much less at the junction of ducts 36 and fluid lines 38*a* and 38*b*. It is noted that the alternative placement of valves 32 in FIG. 2 is not mutually exclusive to the inclusion of additional heater 42 and, therefore, may alternatively be included in system 10 or system 30 described below in reference to FIG. 3.

Another alternative configuration of a system for processing a substrate which includes an in-line microwave heater is shown in FIG. 3. In particular, FIG. 3 illustrates system 50 having in-line microwave heater 30 as well as several other components described in reference to system 10 of FIG. 1 and system 40 of FIG. 2. System 50 differs from system 40, however, by placement of in-line microwave heater 30 and gas displacement system 28 along fluid line 38*a* rather than along ducts 36. The placement of in-line microwave heater 30 along fluid line 38*a* may be advantageous for positioning the heater closer to process chamber 12 and, thus, minimize the time a fluid is at an elevated temperature for processing. In contrast, arranging in-line microwave heater 30 along ducts 36 as shown in FIGS. 1 and 2 may be advantageous for keeping the heater components continuously exposed to fluid such that the formation of dried particles are prevented. Dried particles may a source of contamination when combined with a fluid used to process a substrate and, consequently, may be desirable to avoid. For example, dried particles may be source of nucleation sites when combined with an electroless plating solution, causing the solution to plate out. In other embodiments, a filter may be arranged within fluid line 38*a* when in-line microwave heater 30 is arranged therealong such that dried particles may be removed promptly. In either case, gas displacement system 28 may be arranged on either of fluid line 38*a* or ducts 36, the placement of which is not exclusive to the relative placement of in-line microwave heater 30.

System 50 further differs from systems 10 and 40 by the exclusion of a valve between ducts 36 and fluid line 38*b*. In particular, since the temperature of a fluid within system 50 may not be increased until reaching in-line microwave heater 30 along fluid line 38*a*, fluid may not necessarily be prevented from circulating to fluid line 38*b* when fluid flow is allowed to process chamber 12. In particular, the fluid within the circulation line of system 50 may be maintained at a lower temperature than process chamber 12, while fluid within the supply line may be accordingly increased. In other embodiments, fluid line 38*b* may include a valve by which to prevent fluid flow therethrough.

Figure 4:
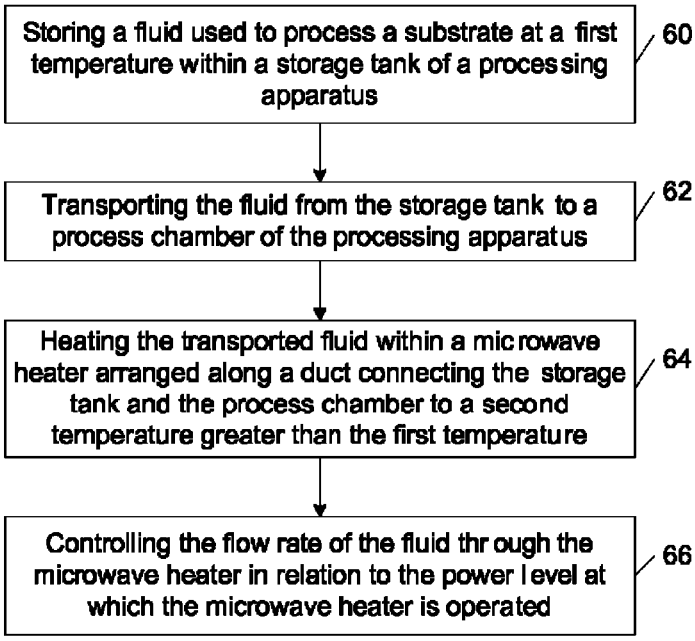
FIG. 4 depicts a flow chart of a method for using the substrate processing systems illustrated in FIGS. 1-3.

A flowchart of a method for operating a system in which a substrate is processed with a heated fluid is illustrated in FIG. 4. In particular, FIG. 4 illustrates a method including block 60 in which a fluid used to process a substrate is stored within a storage tank of a processing apparatus at a first temperature. In some cases, block 60 may include controlling the temperature of the fluid within a preliminary temperature range. More specifically, the processing apparatus may employ one or more temperature controllers with which to control the temperature of the fluid within the storage tank and any circulation lines coupled thereto within a preliminary temperature range. In yet other embodiments, the environment in which the processing apparatus is operated may be adapted to maintain the fluid within the storage tank and any circulation lines coupled thereto within a preliminary temperature range. For example, the processing apparatus may be operated in a temperature controlled environment which has a substantially similar operating range as the preliminary temperature range.

In any case, the preliminary temperature range may preferably include temperatures which do not substantially degrade the life of the fluid as compared to other temperatures at which the fluid may be maintained. For example, in an embodiment in which the fluid is an electroless deposition solution, the preliminary temperature range may include temperatures between approximately 30° C. and approximately 65° C., and in some cases, more specifically between approximately 40° C. and approximately 65° C. Higher or lower temperatures and larger or smaller ranges of temperatures, however, may be used for the preliminary temperature range, depending on the process to be conducted, the operating parameters of the fluid, and the design specifications of the system. For example, in some embodiments, an electroless deposition solution may be maintained at or near room temperature (i.e., between approximately 20° C. and approximately 25° C.).

As shown in FIG. 4, the method may further include block 62 in which the fluid is transported from the storage tank to a process chamber of the processing apparatus. During the step of transporting the fluid from the storage tank to the process chamber, the method may include heating the transported fluid within a microwave heater arranged along a duct connecting the storage tank and the process chamber to a temperature greater than the temperature at which the fluid is stored within the storage tank as noted in block 64 of FIG. 4 and described above in reference to the systems depicted in FIGS. 1-3. In particular, the method may include heating the fluid to a temperature within a processing temperature range which is distinct from the preliminary temperature range of the storage tank. In some cases, the processing temperature range may be optimized to temperatures which offer a high reaction rate as well as a uniform treatment process. For example, exemplary processing temperature ranges for an electroless deposition solution may be between approximately 70° C. and approximately 120° C., and in some cases, more specifically between approximately 70° C. and approximately 95° C. In some cases, block 64 may specifically include increasing the temperature of the fluid at least approximately 20° C. relative to its temperature in the storage tank, in some cases, greater than or equal to approximately 30° C. or greater than or equal to approximately 50° C. Other processing temperature ranges, however, may be employed as well, depending on the process to be conducted, the operating parameters of the fluid, and the design specifications of the system.

As noted above, the systems described herein may include any number of storage tanks for storing a fluid, including serially and parallel arranged tanks. As such, the method described in reference to FIG. 4 may include transporting fluid from any of a plurality storage tanks or a single storage tank within a system and heating the fluid with a microwave heater along a supply line extending from the storage tanks as described above with respect to blocks 62 and 64. In some cases, block 62 may specifically refer to transporting fluid from a storage tank directly to the process chamber. In general, the mode of transporting the fluid "directly" to the process chamber may refer to moving the fluid without significant interruption from the storage tank to the process chamber. In particular, although the fluid may be conveyed through one or more components, such as a pump, filter, gas displacer, and a heater while being transferred directly to a process chamber, the fluid may not be routed to intermediate reservoirs. In other embodiments, the method may include transporting the fluid through a plurality of serially coupled reservoirs. In some embodiments, the reference in block 62 of transporting the fluid from a storage tank may refer to moving the fluid from a reservoir coupled in closest proximity to the process chamber among one or more reservoirs of the process apparatus configured to store the fluid. Such reservoir may be referred to as being "directly" coupled to the process chamber.

In any case, the method may, in some embodiments, further include controlling the flow rate of the fluid through the microwave heater in relation to the power level at which the microwave heater is operated as noted in block 66 in FIG. 4. Such a process is described in detail as a configuration of CPU 26 in regard to system 10 in FIG. 1. In particular, the rate of fluid flow through in-line microwave heater 30 may be monitored and compared to a target rate and the power level of in-line microwave heater 32 may be adjusted accordingly or vice versa. In other embodiments, however, the process step associated with block 66 may be omitted from the method.

It will be appreciated to those skilled in the art having the benefit of this disclosure that this invention is believed to provide a systems and methods incorporating microwave heaters within fluid supply lines of systems used to process substrates. Further modifications and alternative embodiments of various aspects of the invention will be apparent to those skilled in the art in view of this description. For example, although the system and method provided herein are frequently described in reference to process steps conducted prior to, during, and subsequent to an electroless deposition process, the system and method are not necessarily restricted to such processes. In addition, the system and method described herein may be used for any fluid in which the temperature is heated prior to and during processing of a substrate. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system, comprising:

a chamber configured to process one or more wafers for the fabrication of microelectronic devices;

a reservoir configured to store a fluid used to process the one or more wafers;

a supply line for transporting the fluid from the reservoir to the chamber;

a microwave heating system arranged along the supply line; and a controller configured to operate the microwave heating system such that flow of the fluid within the supply line is heated to a first temperature greater than a second temperature of the fluid within the reservoir, wherein the controller comprises a storage medium having program instructions executable by a processor.

2. The system of claim 1, wherein the controller is further configured for operating the microwave heating system at a power of at least approximately 2.0 kilowatts.

3. The system of claim 1, wherein the system is configured to regulate a flow rate of the fluid within the supply line to be between approximately 0.8 liters/minute and approximately 10.0 liters/minute.

4. The system of claim 3, wherein the system is further configured such that a variation of the flow rate is less than or equal to approximately 0.5 liters/minute.

5. The system of claim 1, wherein the system is configured for controlling a flow rate of the fluid within the supply line in relation to the power level at which the microwave heating system is operated.

6. The system of claim 1, wherein the first temperature is at least approximately 20° C. greater than the second temperature.

7. The system of claim 1, wherein the fluid is used to reactively process the one or more wafers.

8. The system of claim 7, wherein the fluid comprises metal constituents.

9. The system of claim 8, wherein the fluid comprises an electroless plating deposition solution.

10. The system of claim 1, further comprising a circulation line coupled between an inlet of the reservoir and a junction along supply line between the microwave heating system and the chamber.

11. A system, comprising:

a chamber configured to process one or more wafers for the fabrication of microelectronic devices;

a reservoir configured to hold a fluid used to process the one or more wafers;

a supply line coupled between an outlet of the reservoir and an inlet of the chamber;

a circulation line coupled between the outlet of the reservoir and an inlet of the reservoir, wherein a portion of the circulation line and a portion of the supply line comprise common fluid ducts;

a microwave heating system arranged among the common fluid ducts;

a valve arranged along the supply line between the microwave heating system and the inlet of the chamber; and a controller configured to operate the microwave heating system, wherein the controller comprises a storage medium having program instructions executable by a processor, and wherein the controller operates the microwave heating system at:

a first power level when the valve is configured to inhibit fluid flow to the inlet of the chamber; and a second power level higher than the first power level when the valve is configured to allow fluid flow to the inlet of the chamber.

12. The system of claim 11, wherein the first power level is between approximately 250 watts and approximately 750 watts, and wherein the second power level is greater than or equal to approximately 2.0 kilowatts.

13. The system of claim 12, wherein the first power level is configured to heat the fluid within a preset temperature range, and wherein the second power level is configured to heat the fluid to a temperature greater than the preset temperature range.

14. The system of claim 11, wherein first power level is negligible, and wherein the second power level is greater than or equal to approximately 0.5 kilowatts.

15. The system of claim 11, further comprising an additional heater arranged along the recirculation line, wherein the additional heater is configured to heat the fluid within a preset temperature range, and wherein the second power level is configured to heat the fluid to a temperature greater than the preset temperature range.

16. The system of claim 11, wherein the second power level is sufficient to heat the fluid within the microwave heating system to a temperature which is at least approximately 20° C. higher than the preset temperature range.

* * * * *